United States Patent [19]

Cabaniss, III

[11] 4,328,795

[45] May 11, 1982

[54] SMOKELESS TOBACCO PIPE

[76] Inventor: Weldon B. Cabaniss, III, 2118 NW. Military Hwy., San Antonio, Tex. 78213

[21] Appl. No.: 146,794

[22] Filed: May 5, 1980

[51] Int. Cl.[3] ..... A24F 1/26

[52] U.S. Cl. ..... 131/180; 131/185; 131/191

[58] Field of Search ..... 131/171 A, 170 Z, 180, 131/181, 182, 178, 179, 198 R, 226, 225, 174, 185, 191

[56] References Cited

U.S. PATENT DOCUMENTS

| | | | |
|---|---|---|---|
| 1,302,047 | 4/1919 | Hurst | 131/180 |
| 1,961,983 | 6/1934 | Pirrone | 131/191 |
| 4,044,781 | 4/1976 | Hegbestuen | 131/180 X |
| 4,183,365 | 1/1980 | Kelly | 131/180 |
| 4,223,687 | 9/1980 | Sandeen | 131/180 |

*Primary Examiner*—Stephen C. Pellegrino
*Attorney, Agent, or Firm*—Gunn, Lee & Jackson

[57] ABSTRACT

A tobacco pipe which directs all of the smoke it produces through the person smoking the pipe prior to release of the smoke to the atmosphere. Storage chambers within the pipe may contain different types of burning material and may be repeatedly accessed for burning the materials in any order desired. The pipe stores its own ashes and has a lighter.

10 Claims, 7 Drawing Figures

SMOKELESS TOBACCO PIPE

BACKGROUND OF THE INVENTION

This invention relates to devices for smoking combustible materials and, more particularly, to a device having a multiplicity of chambers for storage of combustible materials or ash waste materials. The chambers are not in gaseous communication with the smoke passage. The device when constructed with the proper dimensions will enable the smoker to draw the smoke created by burning of the combustible materials through the smoke passage without any substantial amounts of smoke escaping into the atmosphere which has not passed through the smoke passage.

BRIEF DESCRIPTION OF THE PRIOR ART

Prior to the present invention, many types of smoking devices have been designed and built. Some of the devices would have a multiplicity of chambers for storing additional combustible materials. When the smoker wanted to smoke the "reserve" chamber, all he had to do was orientate a given chamber such that the chamber would become the burning bowl and there would be gaseous communication between the smoke passage and the chamber. Such a device can be seen in U.S. Pat. No. 1,302,047.

Another example of a smoking device that uses the principle of alternatively bringing storage chambers in operative relationship with the smoke passage can be found in U.S. Pat. No. 682,278. While not employing the principle of rotating the storage chamber, U.S. Pat. No. 2,216,087 shows that a storage chamber can be alternatively utilized as the burning bowl by rotating a cover plate over one of the several chambers.

Despite the numerous types of smoking devices that have been designed in the past, all of these devices utilize the storage chamber as a burning bowl when brought into the proper orientation with the smoke passage. Once the material in the chamber is burned, the entire chamber must be cleaned. No past design enables the smoker to utilize one or more chambers as waste storage chambers.

In the traditional type of smoking device, smoke from the burning materials freely escapes into the atmosphere from the burning bowl. The smell of the burning material is evident to individuals standing near by. No previous device is designed or constructed such that a small quantity of material is burned and all the smoke is drawn through the smoke passage, optionally filtered in the smoke passage, drawn into the smoker's lungs, naturally filtered, and expelled into the atmosphere.

SUMMARY OF THE INVENTION

It is an object of the present invention to provide a smoking device with chambers for storing additional combustible material, which may be repeatedly accessed for burning the materials in any order desired, but wherein the storage chambers do not also serve as burning bowls.

A further object of the invention is to provide a smoking device which includes one or more chambers for storing ashes until the smoker desires to clean the entire device.

A further object of the invention is to provide a smoking device wherein substantially all of the smoke from burning the combustible material is drawn through the smoke passage prior to release into the atmosphere.

A further object of the invention is to create a novel smoking lighter for lighting smoking devices and to create a smoking device which may be more conveniently carried and used than conventional pipes.

DESCRIPTION OF THE PREFERRED EMBODIMENT

Figure 1:
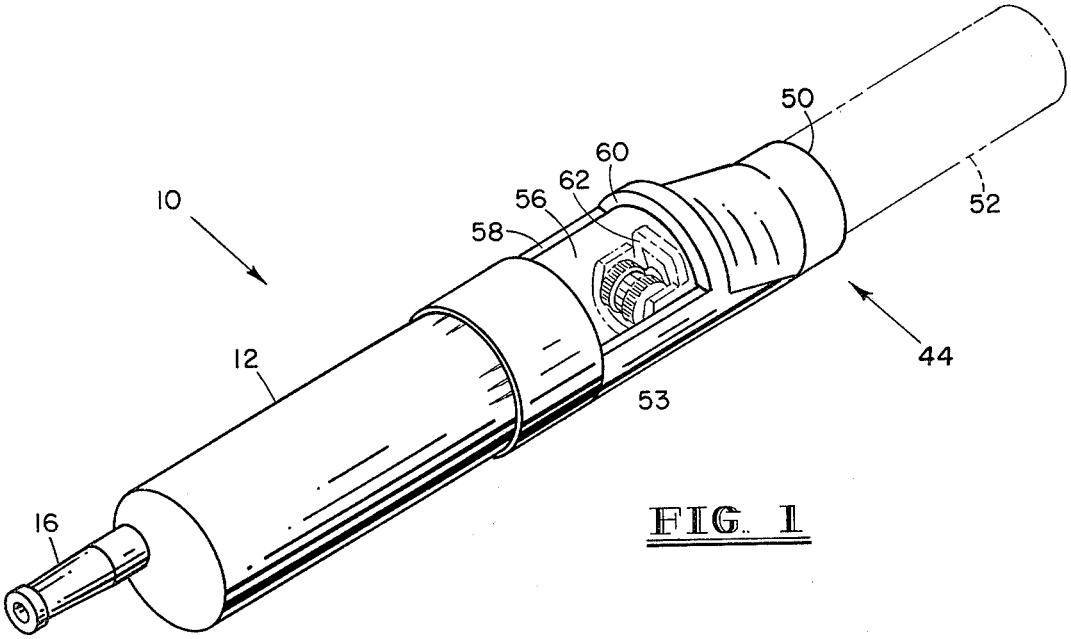
FIG. 1 is a view of the pipe with an igniter attached.
Figure 4:
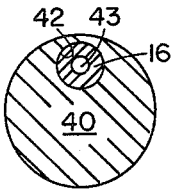
FIG. 4 is a cross-sectional view of the pipe as indicated by section lines in FIG. 3.
Figure 5:
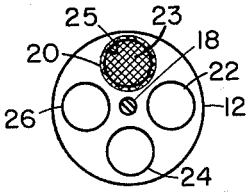
FIG. 5 is a cross-sectional view of the pipe as indicated by section lines in FIG. 3.
Figure 6:
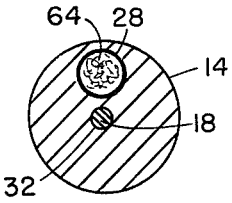
FIG. 6 is a rear view of the cap from the perspective indicated by section lines in FIG. 3.

The major structural elements of the pipe 10 are the body 12, cap 14, stem 16, and cap pin 18. Formed within the body 12 are four chambers comprised of an exhaust chamber 20, and three storage chambers 22, 24 and 26. A filter 23 is wedged within exhaust chamber 20 and upon an inner shoulder 25.

Figure 7:
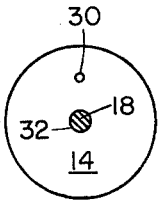
FIG. 7 is a front view of the cap from the perspective indicated by sectional lines in FIG. 3.
Figure 2:
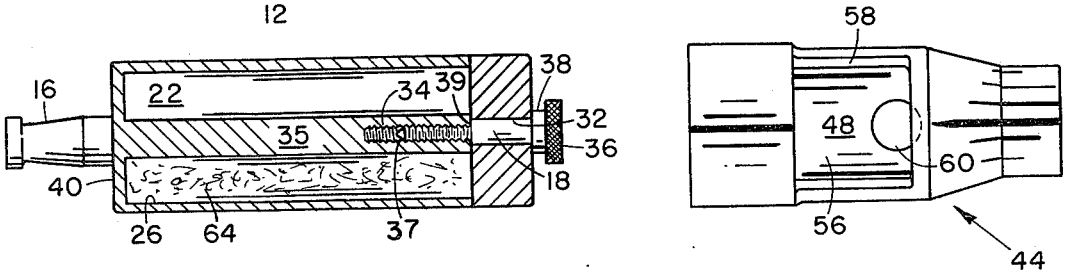
FIG. 2 is a view of a longitudinal cross-section of the pipe together with a view of the igniter.
Figure 3:
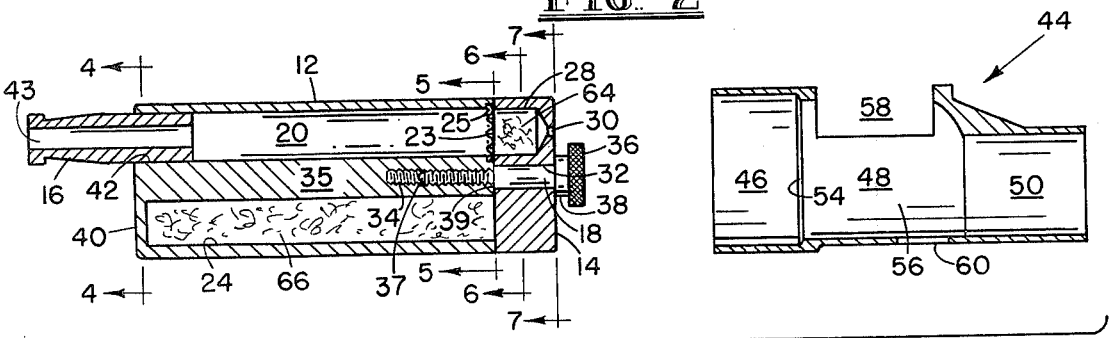
FIG. 3 is a view of a longitudinal cross-section of the pipe taken perpendicular to the cross-section shown in FIG. 2 together with a view of a longitudinal cross-section of the igniter.

A burning bowl 28 is contained within the cap 14 and a small passage 30 connects the burning bowl 28 with the outer surface of the cap 14 as is shown in FIGS. 3 and 7. The cap pin 18 is inserted through cap rotation hole 32 and screwed within threaded hole 34 through the center portion 35 of the body 12. The portion of the cap pin 18 located within the cap 14 is smooth to allow easy rotation of the cap 14 about the cap pin 18. The cap pin 18 has an outer knob 36 to facilitate rotation of the cap pin 18 while either inserting or removing it from the threaded hole 34. A smooth inner shoulder 38 of the cap pin 18 allows the cap 14 to be securely retained upon the body 12 by the cap pin 18 and yet allow the cap 14 to rotate. This inner shoulder 38 may either be an integral part of cap pin 18 or a separate bushing located about it.

An additional inner shoulder 39 of cap pin 18 is located to allow cap pin 18 to be screwed tightly within hole 42 to prevent loosening of cap pin 18 upon rotation of cap 14 and also to prevent cap pin 18 from being screwed so far within hole 42 as to cause pin 18 to clamp tightly upon cap 14 and eliminate cap 14's capacity to freely rotate. The end 37 of cap pin 18 is pointed and is useful in scrapping combustion residues from filter 23. Because the threaded portion of cap pin 18 is shorter than hole 42, pointed end 37 is retained within hole 42 without being dulled in any way.

The rear wall 40 of the body 12 seals off the rear end of chambers 22, 24 and 26. The hole 42 in the rear wall is adapted to closely receive the stem 16. The stem 16 has an inner passage 43. Additionally, the outer radius of stem 16 is slightly smaller than the inner radius of chambers 22, 24 and 26.

An igniter 44 having a cap attachment 46, ignition portion 48, and a lighter portion 50 is also shown. The cap attachment 46 is adapted to closely receive the cap 14 and the inner radius of the lighter portion 50 is adapted to closely receive a lighter 52. A slight shoulder 54 within the inner end of the cap attachment 46 limits the advance of the cap 14 within the igniter 44. The lighter contemplated for use has an activater 53, here shown as a rotatable metal wheel having a friction contact with a flint. A lighter 52, such as is shown in the Figures, is commonly available, a typical such lighter being sold under the trademark Cricket by Gillete Corp. and typically utilizing compressed hydrocarbon gas as its flammable material. The ignition portion of the lighter 48 is comprised of a cavity 56, a finger access 58, and an access port 60 to adjust the flame on the lighter 48. A lighter lip stop 61 retains the lighter 52 within the igniter 44 by fitting against a protruding lip 62 of the lighter 52.

To prepare the pipe for operation, the smoker will put one blend of tobacco or other burnable material 64 within chamber 26 and another blend of tobacco 66 within chamber 24. The stem 16 and filter 23, if not previously located within the body 12, are inserted within their respective positions as is shown in FIG. 3. The cap 14 is then attached to the body 12 by placing the pin 18 through the cap rotational hole 32 and threading it into the threaded hole 34 so it firmly retains the cap 14 upon the body 12. The igniter 44, already having the lighter 52 placed within it, is then affixed about the cap 44.

In operation, the smoker rotates the cap 14 so the burning bowl 28 is adjacent to either chamber 24 or 26 depending upon which blend of tobacco is desired to be smoked. The pipe 10 is then held vertically, stem 16 upward, and shaken by the smoker to fill the burning bowl 28 with blend 64 from chamber 26 (assuring that is the blend selected). The smoker then rotates the cap 14 about the pin 36 so the burning bowl 28 is located adjacent to exhaust chamber 20.

To ignite tobacco blend 64, igniter 44 is attached to pipe 10. The pipe itself is normally oriented with inner passage 43 being uppermost and igniter 44 oriented with finger access 58 located lowermost. This directs the lighter 52 directly toward small passage 30 and is the most convenient position for the smoker. The smoker next raises the pipe 10 to a horizontal position, places his thumb within the finger access 58 of the igniter 44, and activates the lighter 52. The lighter 52 bathes the outer portion of the cap 14 containing the small passage 30 in flame. The smoker then gently inhales through the stem cavity 43, the exhaust chamber 20, filter 23, the burning bowl 28, small passage 30, and cavity 56 of the igniter 44. The draw, or gaseous movement created by such inhalation, pulls the frame through the small passage 30 and into the burning bowl 28 where the flame ignites the tobacco blend 64 held within burning bowl 28. Once the tobacco blend 64 is ignited, the lighter 52 may be extinguished and the igniter 44 removed from the pipe 12.

The smoker now has a small ignited portion of tobacco blend 64 contained within the burning bowl 28. Because the cap 14 is held closely adjacent to the body 12 by pin 36, no substantial amounts of smoke may escape to the atmosphere from between the cap 14 of the body 12. The diameter of the small passage is preferably less than 3 centimeters. Further, such portion of the tobacco blend 64 as may be adjacent to the small passage 30 was, in the main, completely burned during the lighting process. Therefore, very little if any of the smoke from the burning tobacco blend 64 filters through the charred tobacco adjacent to the small passage 10 and out through the extremely small diameter passage 30. Because of the small diameter of the small passage 30 and the minimal size of the burning bowl 23, there is generally insufficient oxygen to allow any combustion of the tobacco blend 64 unless the smoker is actively drawing oxygen through the tobacco blend 64 as he inhales through the pipe 10. Further, because of the small amount of combustible material allowed within the small burning bowl 28, insufficient quantities will be present to sustain burning for a long period of time. Each of these factors may necessitate frequent relighting and/or refilling of the burning bowl 28 with more combustible material. They are specifically designed into the pipe 10, however, to decrease the amount of combustion occuring while the smoker is not inhaling through the pipe 10.

It is thus seen that the only significant pathway for the smoke to escape is through the exhaust chamber 20 and stem cavity 43. Even here, only small amounts of smoke will of its own accord travel the long distance through exhaust chamber 20 and out through stem cavity 43. However, when the smoker inhales through the stem cavity 43 air is drawn through the small passage 30 to provide oxygen for the now smoldering tobacco blend 64. Further, when the smoker is not inhaling, smoke producing combustion of the tobacco blend 64 is generally halted due to lack of oxygen to fuel the burning. Significant smoke producing combustion of the tobacco blend 64 is thus renewed and the resulting smoke is drawn through the exhaust chamber 20 and the stem cavity 43 to the smoker.

If the smoker does not regularly inhale upon the pipe 10, the burning tobacco blend 64 will eventually extinguish due to lack of oxygen and will require reignition. If, on the other hand, the smoker continues to inhale through the pipe 10, the small amount of tobacco blend 64 within the burning bowl 28 will soon totally burn out due to depletion. When this occurs, the cap 14 may be rotated about the pin 18 so the burning bowl 28 is adjacent to chamber 22. The pipe 10 may then be held vertically by the smoker with the cap portion 14 held upward and shaken. This will cause the burned out tobacco blend 64 to fall within chamber 22. Additionally, certain finely chopped tobacco blends may be exhausted from the pipe by the smoker simply blowing through stem 16 to force the burned particles out through small passage 30. The cap 14 is then rotated so the burning bowl 28 is adjacent to either chamber 26 having tobacco blend 64 or chamber 24 having tobacco blend 66, whichever the smoker desires. The pipe 10 would then be turned upside down to fill the burning bowl 28 with the tobacco blend 64 or 66 as selected by the smoker, and the smoker could then repeat the process as previously described above.

When not in use, the stem 16 may be stored within any of chambers 22, 24 or 26 as may be convenient. The inner radius of burning bowl 28 is sized to closely receive the outer radius of stem 16. Thus, when storing stem 16, it is first fixed within burning bowl 28 and then the remaining portion placed within an appropriate chamber 22, 24 or 26. The reason for affixing stem 16 within burning bowl 28 is to permit removal of stem 16 from pipe 10 by removing cap 14 from pipe 10 while pipe 10 is in an upright position. Otherwise, removal of stem 16 would require shaking it out of pipe 10 during which process much tobacco could be lost.

After the cap 14 is secured upon the body 12 by the pin 18, the pipe 10 containing the stem 16 and two blends of tobacco 64 and 66 may be conveniently carried in one unit by the smoker without inconvenience or fear of spilling the contents of the pipe 10. Upon deciding to smoke, the smoker merely removes the cap 14, takes out and inserts the stem 16, and replaces the cap 14 to have a pipe 10 ready for ignition. Pipes as presently known in the art are much less convenient to transport and to prepare for ignition.

The pipe 10 and igniter 44 combination described above has numerous advantages over all other known pipe and lighter combinations. The invention allows the smoker to burn tobacco or such other materials as he may desire and to inhale substantially all of the smoke produced by the burning material. This is important because many non-smokers are extremely adverse to being subjected to unfiltered smoke. It has been found, however, that the effect of smoke filtered by the smoker's lungs is much less than is the effect of unfiltered smoke upon the non-smoker. This is particularly true as concerns odors. It is thus seen that a device has been described which makes it possible for a smoker to smoke tobacco or other combustible materials within the presence of a non-smoker without offending the non-smoker.

Another desired result achieved by the above device is the ability to conveniently store at least two different types of burning materials within a pipe which may burn either material as the smoker desires. While other pipes having more than one burning bowl are known, the present invention allows frequent switching back and forth between the alternate sources of burning material without totally consuming either material.

Another desired result is that little of the tobacco is wasted due to the smoker only burning very small amounts of the tobacco at a time. With certain very expensive blends of burning materials, insuring complete combustion of the material may be important. The burning of loosely packed amounts of the tobacco only while a fresh supply of air is being drawn through it additionally promotes extremely complete combustion of the tobacco.

The linear design of exhaust chamber 20 is in marked contrast to the curved exhaust chambers prevalent among current pipes and facilitates cleaning of exhaust chamber 20. Additionally, the features of storing stem 16 and separate quantities of tobacco blends 64 within the pipe 10 itself allows for convenient transport of the pipe 10. An additional option which may be desired by some smokers would be the location of a filter within exhaust chamber 30. Many usable filters are available and the disclosed pipe 10 is well adapted for changing or adding such filters whenever desired.

The special ignition 44 described herein allows ignition of the pipe 10 in practically all conceivable conditions of weather. It is specially adapted to supply sufficient heat directed directly through the small passage 30 and into the burning bowl 28 to ignite the material held there. Because of the small diameter of the small passage 30, use of the special igniter 44 is preferred for easy lighting of the pipe 10.

Further, the separate chamber 22 for storing burned out materials and ashes further makes the pipe 10 an extremely unoffensive smoking pipe.

It is understood that other structures may be suggested by the claims. The purpose of the above description is to illustrate the preferred embodiment and is not intended as a limitation upon the claims.

I claim:

1. A device for smoking combustible materials comprising:

a body member having a smoke passage within said body member;

at least one chamber for storing said combustible materials located within said body member and separate from said smoke passage;

a cap member containing a recessed portion for burning said combustible materials therein;

an orifice located in said cap member for communicating from the atmosphere to said recessed portion; said orifice being less than three centimeters in diameter to prevent substantial loss of combustible material from said recessed portion and through said orifice to outside of said device and to prevent substantial amounts of smoke produced by burning said combustible material within said recessed portion from passing out through said orifice and into the atmosphere by preventing significant gaseous communication between the atmosphere and said combustible material through said orifice in the absence of an air pressure differential between said recessed portion and said atmosphere and;

said cap member being rotatably attached to a front end of said body member and having a first orientation wherein said recessed portion of said cap member is directly adjacent to and opens into a front end of said smoke passage, and a second orientation wherein said recessed portion is directly adjacent to and opens into a front end of said chamber.

2. The device of claim 1 additionally comprising at least two chambers for storing said combustible materials, said cap member being rotatable to be capable of alternatively placing said recessed portion in communication with either of said chambers so said combustible material may be transferred from either of said chambers to said recessed portion.

3. The device of claim 1 wherein at least one of said chambers is a products chamber for storing products produced by burning said combustible materials within said recessed portion, and wherein said cap member is rotatable to alternatively locate said recessed portion directly adjacent to and opening into said products chamber or locate said recessed portion directly adjacent to and opening into a chamber within said body member other than said products chamber.

4. The device of claim 3 wherein at least one of said chambers is a storage chamber for storing combustible material to be burned within said recessed portion and wherein said cap member is rotatable to alternatively locate said recessed portion directly adjacent to and opening into said storage chamber for communicating materials to said recessed portion from said storage chamber or to be located directly adjacent to another portion of said body member.

5. The device of claim 1 wherein said smoke passage, said recessed portion, and said orifice are along a common axis when said cap member is in said first orientation.

6. The device of claim 1 wherein at least one of said chambers is parallel to said smoke passage.

7. The device of claim 1 further comprising a removable mouthpiece attached to said smoke passage, said removable mouthpiece being removable from said smoke passage and sized to fit into said chamber in said body member for storage of said mouthpiece.

8. The device of claim 1 further comprising igniter means for igniting said combustible materials, said igniter means being attachable to said cap member, having igniter activation means, and having a sheltered cavity for igniting said combustible materials within said recessed portion, said igniter means being designed and constructed for convenient repeated ignition and said combustible materials within said recessed cavity.

9. The device of claim 1 wherein said cap member is rotatively attached to said body member by means of a cap pin, a rear portion of said cap pin being located through a portion of said cap member to retain said cap member, and a forward portion of said cap pin being attachable to said body member, said forward portion of said cap pin also being pointed for use in cleaning said device.

10. A device for smoking combustible material comprising:

a body member having a smoke passage within said body member;

a cap member rotatably attached to a front end of said body member and containing a recessed portion for burning for burning said combustible materials therein;

at least two chambers located within said body member and separate from said smoke passage;

at least one of said chambers being a products chamber for storing products produced by burning said combustible materials within said recessed portion, and least one other of said chambers is a storage chamber for storing combustible material to be burned within said recessed portion, at least two chambers located within said body member and separate from said smoke passage;

an orifice located in said cap member for communicating from the atmosphere to said recessed portion; said orifice being less than three centimeters in diameter to prevent substantial loss of combustible material from said recessed portion and through said orifice to outside of said device and to prevent substantial amounts of smoke produced by burning said combustible material within said recessed portion from passing out through said orifice and into the atmosphere by preventing significant gaseous communication between the atmosphere and said combustible material through said orifice in the absence of an air pressure differential between said recessed portion and said atmosphere and;

said cap member having at least three orientation relative to said body member is directly adjacent to and opens into a front end of said smoke passage a second orientation wherein said recessed portion is directly adjacent to and opens into said products chamber; and a third orientation wherein said recessed portion is directly adjacent to and opens into said storage chamber.

* * * * *